United States Patent [19]

Bata et al.

[11] Patent Number: 4,949,904

[45] Date of Patent: Aug. 21, 1990

[54] CALIBRATION OF FUEL INJECTORS VIA PERMEABILITY ADJUSTMENT

[75] Inventors: George T. Bata, Grafton; David P. Wieczorek, Newport News, both of Va.

[73] Assignee: Siemens-Bendix Automotive Electronics L.P., Troy, Mich.

[21] Appl. No.: 390,563

[22] Filed: Aug. 7, 1989

[51] Int. Cl.[5] ..... F02M 51/00; F02M 65/00

[52] U.S. Cl. ..... 239/5; 239/585; 73/119 A; 251/129.15; 335/237

[58] Field of Search ..... 239/5, 585; 73/119 A; 251/129.15, 129.18; 335/237, 258

[56] References Cited

U.S. PATENT DOCUMENTS

| | | | |
|---|---|---|---|
| 3,004,546 | 10/1961 | Robins et al. | 335/237 |
| 4,218,669 | 8/1980 | Hitchcock et al. | 335/258 |
| 4,254,653 | 3/1981 | Casey et al. | 73/119 A |
| 4,545,530 | 10/1985 | Hofmann et al. | 73/119 A |
| 4,830,333 | 5/1989 | Watson | 251/129.18 |

*Primary Examiner*—Andres Kashnikow
*Assistant Examiner*—Karen B. Merritt
*Attorney, Agent, or Firm*—George L. Boller; Russel C. Wells

[57] ABSTRACT

An electromagnetic fuel injector is calibrated for dynamic flow by creating a blind hole in a stationary pole piece passing through the solenoid coil. The blind hole can be created by drilling, or by partially filling a pre-existing hole.

8 Claims, 1 Drawing Sheet

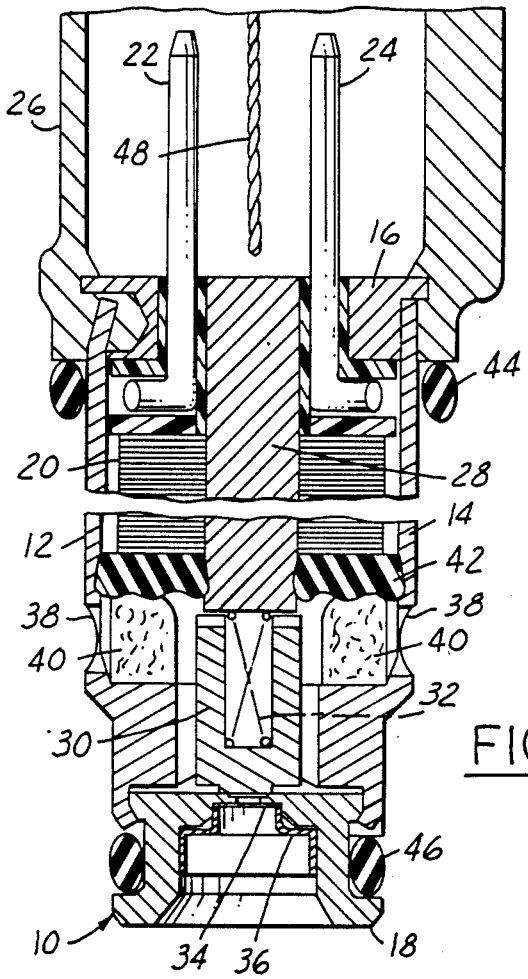
FIG. 1
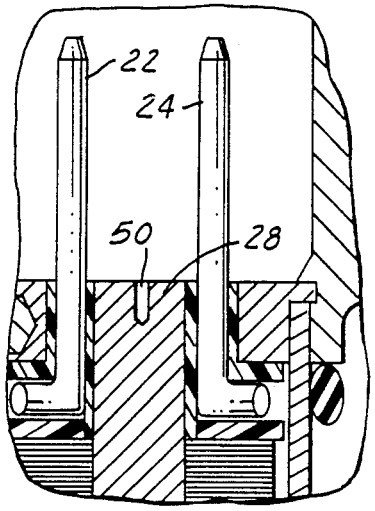
FIG. 2
FIG. 3
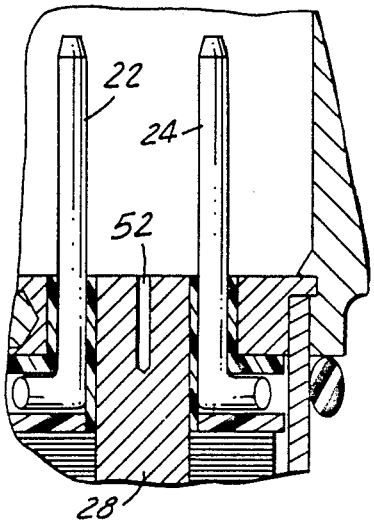
FIG. 4
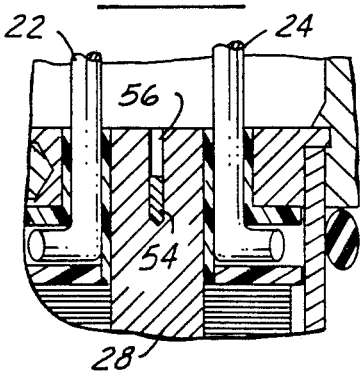

CALIBRATION OF FUEL INJECTORS VIA PERMEABILITY ADJUSTMENT

BACKGROUND AND SUMMARY OF THE INVENTION

This invention relates to electromagnetic fuel injectors of the type used in internal combustion engine fuel injection systems and to methods of calibrating such fuel injectors.

Electromagnetic fuel injectors are used to control the amount of fuel that is introduced into the cylinders of an internal combustion engine. One of the important advantages of such fuel injectors is the degree of precision with which fuel can be introduced. However, to attain such precision it is necessary for the injectors to be properly calibrated.

The primary performance characteristics of injectors are: wide-open, or static, flow; dynamic flow; and linearity. Static flow is the flow achieved when the injector is energized with steady current. Dynamic flow is the flow delivered when the injector is pulsed with an electrical signal, usually measured in milliseconds. During the calibration of an injector, static flow is established by adjusting the injector's orifices, normally consisting of a fixed orifice and a variable orifice in series. The latter orifice is defined by the injector's valve lift which is adjustable. After the static flow has been established for the injector, the dynamic flow is set by loading a spring against an armature until a desired dynamic flow is achieved, and then locking the adjustment mechanism. Spring loading of the armature adjusts the opening and closing times of the injector, but does not affect the static flow.

The present invention relates to the calibration of the dynamic flow of an electromagnetic fuel injector. Calibration is attained by removing or adding magnetically permeable material to the magnetic flux path to thereby establish the opening and closing times that determine the dynamic flow. This novel method involves creating in a stationary part of the injector's magnetic circuit, a blind hole of a depth that will produce the desired dynamic flow. The appropriate depth for the blind hole can be created in either of two ways. One, by drilling a blind hole to the appropriate depth, and two, by drilling a principal hole to a depth greater than that of the appropriate depth, and then partially filling the principal hole until the appropriate depth is attained.

The invention offers significant advantages over prior techniques. The conventional prior technique for dynamic flow calibration requires an O-ring to seal the moving part which adjusts the spring force, a push pin, and some means of locking the adjustment mechanism. With the present invention that O-ring can be eliminated, yielding improved reliability and reduced cost by part elimination. The capability for achieving very good calibration accuracy is present because the diameter and depth of the blind hole can be closely controlled. The predictability of the adjustment could allow for group adjustment of injectors after their initial performance has been established.

The foregoing features, advantages, and benefits of the invention, along with additional ones, will become apparent in the following detailed description and claims which are accompanied by drawings of a presently preferred embodiment of the invention in accordance with the best mode contemplated at this time for carrying out the invention.

BRIEF DESCRIPTION OF THE DRAWINGS

FIG. 1 is a cross sectional view of an electromagnetic fuel injector illustrating the beginning of a step in the practice of the invention, a portion of the injector being sectioned away.

FIG. 2 is a fragmentary view of a portion of the injector of FIG. 1 illustrating the completion of the step.

FIGS. 3 and 4 are views similar to FIG. 2, but of another way to practice the invention.

DESCRIPTION OF THE PREFERRED EMBODIMENT

FIG. 1 shows a representative electromagnetic fuel injector 10 comprising a body 12 consisting of a generally cylindrical side piece 14 and end pieces 16, 18 at opposite ends of side piece 14. These three parts are fabricated of magnetically permeable material since they form a portion of the magnetic circuit of the injector.

An electromagnetic coil assembly 20 is disposed within body 12 concentric with the main axis. Electrical terminals 22, 24 provide for the electrical circuit connection of the coil assembly with mating terminals (not shown) leading to an electronic control unit (not shown) for operating the injector. The exterior portions of terminals 22, 24 are bounded by an insulator 26 that is secured to body 12. The interior portions of the terminals are suitably insulated from body 12.

Associated with coil assembly 20 are a stationary pole piece 28 and a movable armature piece 30. Stationary pole piece 28 is cylindrical and fits snugly coaxially within coil assembly 20, also passing through end piece 16. Movable armature piece 30 is disposed within body 12 in coaxial alignment with stationary piece 28. A blind hole in piece 30 contains a helical coil spring 32 that serves to bias piece 30 in the direction away from piece 28 so that the tip end of piece 30 closes a small hole that passes concentrically through end piece 18. A thin disc orifice member 34 is disposed on the opposite side of end piece 18 from armature piece 30 and contains an even smaller concentrically located hole. The thin disc orifice member is retained in place on end piece 18 by means of a retainer 36 that is pressed into end piece 18.

Between coil assembly 20 and end piece 18, side piece 14 contains a fuel inlet 38 at which the injector is communicated to pressurized liquid fuel, such as gasoline. Just within the fuel inlet is a filter 40. An annular sealing gasket 42 seals coil assembly 20 from fuel inlet 38. A pair of O-rings 44, 46 around the outside of body 12 at opposite ends function to seal between the fuel inlet and the mounting (not shown) for the fuel injector. A fuel flow path is provided through the injector between fuel inlet 38 and the hole in orifice disc 34. This path is closed when armature piece 30 is seated on end piece 18.

When solenoid coil assembly 20 is energized from the electronic control unit (not shown), armature piece 30 unseats from end piece 18, opening the fuel flow path through the injector. Fuel that previously entered the injector at inlet 38 is now emitted through orifice disc 34. When the coil assembly is de-energized, the armature piece again seats on end piece 18, closing the fuel flow path through the injector so that fuel ceases to be emitted from the injector. The repeated high frequency pulsing of the coil assembly creates dynamic flow through the injector.

The response of armature piece 30 to the coil pulsing determines the dynamic flow calibration. The armature piece, along with the stationary pole piece 28, form a part of the magnetic circuit associated with coil assembly 20. Changing particular characteristics of the magnetic circuit will change the response of armature piece 30, and hence change the dynamic flow characteristic. The present invention provides a simplified procedure for accomplishing this change, and hence for calibrating the dynamic flow.

According to a first embodiment of the invention as portrayed by FIGS. 1 and 2, the permeability of the magnetic circuit associated with coil assembly 20 is adjusted to create the desired dynamic flow characteristic. The several parts of the injector are designed so that for prevailing manufacturing tolerances, the injector's magnetic circuit will contain either exactly the precise amount of magnetically permeable material or a slight excess of such material. The injector is mounted in a suitable mounting that communicates fuel inlet 38 to a source of fuel under suitable pressure. Connections are made to terminals 22 and 24 to enable the coil assembly to be pulsed with electrical current at suitable amperage and frequency. The fuel output from the injector is measured. If the injector, as initially assembled, contains the correct magnetic permeability in its magnetic circuit, the fuel output will be within tolerance, and no further calibration is needed. However, if that is not the case, then the present invention comes into play.

According to principles of the invention, material is removed from the magnet circuit until the proper magnetic permeability is attained. In FIGS. 1 and 2, material is removed from stationary piece 28. Specifically, material is removed by advancing a rotating drill bit 48 coaxially toward the exterior end of piece 28 and drilling a blind hole 50 of suitable depth to yield the desired dynamic flow calibration. Because the presence of drill bit 48 affects the permeability of the injector's magnetic circuit, measurement of the dynamic flow calibration of an individual injector containing a hole 50 should be made only after the drill bit has been removed. If it is found that an insufficient amount of material has been removed from piece 28, then the hole is drilled deeper, the drill bit removed, and the calibration re-checked. While this procedure can be repeated as necessary, a depth for proper calibration can usually be determined through engineering calculations so that only a single drilling operation need be performed if a hole 50 needs to be created.

Another way to attain the same result is shown in FIGS. 3 and 4. Piece 28 is provided with a pre-existing principal hole 52 of a size at least as large as that which will yield the desired dynamic flow calibration in the initially assembled injector. The injector is suitably mounted and pulsed, and the flow measured. If the dynamic flow is within tolerance, there is no need for further dynamic calibration. However, if that is not the case, calibration is performed by filing hole 52 with magnetically permeable material 54 up to the appropriate depth to achieve the circuit permeability that will produce an in-tolerance response. The result is still that a blind hole 56 is created in pole piece 28.

One advantageous way to produce a group of injectors whose dynamic flows are within a desired tolerance is by designing the injector with an existing hole 50 of a certain size. Upon testing of the group, a certain number should be within tolerance so that no further calibration of these particular injectors is needed. Out-of-tolerance injectors are then brought into tolerance by making their holes 50 either deeper or shallower, as required.

The procedures of the invention are thus seen to be quite straight-forward and an improvement over prior calibration procedures. While a preferred embodiment of the invention has been disclosed, it is to be appreciated that principles are applicable to other embodiments.

What is claimed is:

1. The method of calibrating a fuel injector for desired dynamic fuel flow, said fuel injector being of the type comprising a body, a fuel path through said body leading from a pressurized fuel inlet to a fuel outlet, a solenoid coil and an associated magnetic circuit that are associated with said fuel path and arranged to be operated to create dynamic flow through said fuel path, said method comprising:

operating the fuel injector under certain controlled conditions to create dynamic fuel flow through said fuel path;

measuring the fuel flow through the injector while so operating the injector; and while the fuel injector is so operating, creating a blind hole in said magnetic circuit to cause the injector to produce a desired dynamic fuel flow.

2. The method set forth in claim 1 in which said magnetic circuit comprises a stationary pole piece and wherein said blind hole is created in said stationary pole piece.

3. The method set forth in claim 2 in which said stationary pole piece is coaxial with said solenoid coil and wherein said blind hole is created coaxially in one end of said pole piece.

4. The method set forth in claim 3 wherein said blind hole is created by drilling into said pole piece to a depth that produces the desired dynamic fuel flow.

5. The method set forth in claim 3 wherein said blind hole is created by partially filling a principal hole in said pole piece with magnetically permeable material to a depth that produces the desired dynamic fuel flow.

6. In an electromagnetic fuel injector having a body, a fuel path through said body leading from a pressurized fuel inlet to a fuel outlet, a solenoid coil, a magnetic circuit linking said solenoid coil with said fuel path, said magnetic circuit comprising a stationary part and a movable part, said movable part being operated in response to pulsing of said solenoid coil to cause dynamic fuel flow through said fuel path, the improvement for securing desired dynamic flow calibration of the injector, said improvement comprising a blind hole in said stationary part having a depth that creates the desired dynamic flow calibration.

7. The improvement set forth in claim 6 in which said stationary part is coaxial with the axis of the injector and said blind hole is coaxial with said stationary part, extending into said stationary part from one axial end thereof.

8. The improvement set forth in claim 6 in which the depth of said blind hole that creates the desired dynamic flow calibration is defined by a principal hole that is partially filled with magnetically permeable material to a level that produces the depth that creates the desired dynamic flow calibration.

* * * * *